US012729534B2

(12) United States Patent
Topr

(10) Patent No.: US 12,729,534 B2
(45) Date of Patent: Sep. 8, 2026

(54) WALL PANEL WITH WINDOW APERTURE

(71) Applicant: Mikhail Topr, Rye, NY (US)

(72) Inventor: Mikhail Topr, Rye, NY (US)

( * ) Notice: Subject to any disclaimer, the term of this patent is extended or adjusted under 35 U.S.C. 154(b) by 82 days.

(21) Appl. No.: 18/417,012

(22) Filed: Jan. 19, 2024

(65) Prior Publication Data

US 2025/0237056 A1 Jul. 24, 2025

(51) Int. Cl.

*E04B 2/74* (2006.01)
*E04B 2/76* (2006.01)
*E04B 2/02* (2006.01)

(52) U.S. Cl.

CPC ..... *E04B 2/7411* (2013.01); *E04B 2/764* (2013.01); *E04B 2002/0247* (2013.01); *E04B 2103/02* (2013.01)

(58) Field of Classification Search

CPC ..... E04B 1/14; E04B 1/62; E04B 2/20; E04B 2/24; E04B 2/26; E04B 2/64; E04B 2/7411; E04B 2/764; E04B 2/86; E04B 2/8611; E04B 2/8617; E04B 2002/0247; E04B 2103/02; E04B 5/026; E04B 5/04; E04B 5/326; E04C 2/044; E04C 2/288; E04C 2/46

USPC ..... 52/656.3

See application file for complete search history.

(56) References Cited

U.S. PATENT DOCUMENTS 1,109,785 A * 9/1914 Reier ..... E04B 5/04 52/351
1,226,214 A * 5/1917 Hopkins ..... E04B 2/86 52/421
1,550,606 A * 8/1925 Dale et al. ..... E04B 5/21 52/577
1,562,707 A * 11/1925 Lake ..... B28B 23/028 249/28
1,619,570 A * 3/1927 Duchemin ..... E04C 2/044 264/308
1,649,481 A * 11/1927 Mcwane ..... E04B 1/62 52/410
1,661,009 A * 2/1928 Payne ..... E04B 2/14 52/320

(Continued)

FOREIGN PATENT DOCUMENTS

CN 206570986 U * 10/2017
EP 2679739 A2 * 1/2014 ..... E04B 2/7401
ES 2898608 T3 * 3/2022 ..... E04B 5/38

*Primary Examiner* — Brian D Mattei
*Assistant Examiner* — Joseph J. Sadlon
(74) *Attorney, Agent, or Firm* — Nadya Reingand

(57) ABSTRACT

The present technical solution relates to the field of construction, specifically to constructional wall panels with a window aperture. The technical result is to eliminate thermal bridges, simplify manufacture of. A removable formwork is installed on a vibrating table to form the upper surface 5, the lower surface and two lateral surfaces 6 of the wall panel. Concrete mortar is poured to form the second plate 7. After setting of the concrete mortar and primary hardening, thermal insulation is installed. On the side of the formwork, thermal insulation elements 3 are installed to form a window aperture. Thermal insulation plates are laid on the fourth surface of the second plate 7 to form a second thermal insulation layer 10. The thermal insulation plates are laid at a distance to one another, allowing for cross members and ribs 12 to be formed further.

4 Claims, 2 Drawing Sheets

(56) References Cited

U.S. PATENT DOCUMENTS 1,785,067 A * 12/1930 Bemis ..... E04B 1/20 52/258
1,821,015 A * 9/1931 Hull ..... E04B 1/08 52/236.7
2,007,148 A * 7/1935 Kunze ..... E04C 2/044 52/600
2,100,958 A * 11/1937 Honigmann ..... E04B 2/10 52/396.08
2,206,939 A * 7/1940 Carilli ..... E04B 5/32 249/31
2,465,687 A * 3/1949 Jacobsen ..... E04B 1/20 52/424
3,218,774 A * 11/1965 Mcniel ..... E04C 2/044 52/378
3,292,329 A * 12/1966 Garancsy ..... E04B 2/16 52/274
3,775,240 A * 11/1973 Harvey ..... B28B 19/00 428/116
4,125,981 A * 11/1978 MacLeod ..... E04B 1/161 52/351
4,357,783 A * 11/1982 Shubow ..... E04B 1/161 52/439
4,441,292 A * 4/1984 Ericsson ..... E04B 5/026 52/309.7
4,498,266 A * 2/1985 Perreton ..... E04C 1/41 52/405.4
4,612,749 A * 9/1986 Beltrame ..... E04B 1/14 52/561
4,616,459 A * 10/1986 Shubow ..... E04B 1/20 52/741.15
4,625,484 A * 12/1986 Oboler ..... E04B 5/04 52/437
4,634,359 A * 1/1987 Sartorio ..... E04B 2/8617 249/161
4,829,733 A * 5/1989 Long ..... E04C 2/044 52/250
4,936,069 A * 6/1990 Hunter ..... E04C 2/292 52/794.1
5,102,027 A * 4/1992 Se Hong ..... B21F 27/128 228/4.1
5,104,715 A * 4/1992 Cruz ..... E04C 2/205 428/140
5,172,532 A * 12/1992 Gibbar, Jr. ..... E04C 2/205 52/309.12
5,459,966 A * 10/1995 Suarez ..... A47K 4/00 52/309.1
5,601,888 A * 2/1997 Fowler ..... C04B 28/14 428/68
6,026,629 A * 2/2000 Strickland ..... E04C 2/384 52/794.1
6,116,836 A * 9/2000 Long, Sr. ..... E04C 2/044 52/700
6,442,908 B1 * 9/2002 Naccarato ..... E04B 5/043 52/250
6,625,948 B2 * 9/2003 Valente ..... E04B 5/36 52/745.1
6,698,150 B1 * 3/2004 DiLorenzo ..... E04B 5/04 52/412
6,729,090 B2 * 5/2004 Messenger ..... E04C 2/049 52/794.1
6,955,014 B2 * 10/2005 LeJeune ..... B28B 23/0025 52/223.6
6,955,015 B2 * 10/2005 Manthei ..... E04B 2/06 52/584.1
7,685,789 B2 * 3/2010 Houben ..... B28B 23/028 52/576
8,161,699 B2 * 4/2012 LeBlang ..... E04C 3/09 52/309.4
8,186,128 B2 * 5/2012 Way ..... E04B 1/163 52/259
8,272,190 B2 * 9/2012 Schiffmann ..... B29D 99/0017 52/270
8,327,593 B2 * 12/2012 Laprise ..... E04C 2/205 52/592.1
8,800,227 B2 * 8/2014 LeBlang ..... E04C 3/09 52/309.11
8,857,116 B2 * 10/2014 Henriquez ..... E04B 1/161 52/506.05
8,877,329 B2 * 11/2014 Ciuperca ..... B32B 13/12 52/424
8,881,483 B2 * 11/2014 Caboni ..... E04B 1/90 52/426
8,898,983 B2 * 12/2014 Fu ..... E04C 1/40 52/428
9,016,018 B2 * 4/2015 Boyle ..... E04F 15/185 52/749.11
9,783,993 B2 * 10/2017 Gleeson ..... E04F 13/0807
9,790,682 B2 * 10/2017 O'Neill ..... B32B 3/30
9,809,981 B2 * 11/2017 Ciuperca ..... B32B 7/08
9,822,527 B1 * 11/2017 Ruga ..... B28B 7/348
9,951,519 B2 * 4/2018 Neil ..... E04B 1/66
9,976,341 B2 * 5/2018 Nelson ..... A62C 2/12
10,066,383 B1 * 9/2018 Perasso ..... E04B 1/167
10,077,553 B2 * 9/2018 Neumayr ..... E04B 1/14
10,208,438 B2 * 2/2019 Peeters ..... E01D 19/125
10,422,133 B2 * 9/2019 VanHoose ..... E04C 2/288
10,577,798 B1 * 3/2020 Hodgson ..... E04B 2/38
10,661,475 B2 * 5/2020 Pickman ..... E04B 1/41
10,895,071 B2 * 1/2021 Rutledge ..... E04B 5/023
11,214,964 B2 * 1/2022 Dombowsky ..... E04C 2/2885
11,346,100 B1 * 5/2022 Blackburn ..... E04G 11/08
11,377,850 B2 * 7/2022 Baily ..... E04B 2/707
11,753,823 B2 * 9/2023 Tanaka ..... C04B 20/1029 52/223.1
11,905,707 B2 * 2/2024 Giles ..... C08J 9/148
12,060,710 B2 * 8/2024 VanHoose ..... B28B 19/003
12,139,911 B1 * 11/2024 Lopes ..... E04C 2/288
12,503,844 B2 * 12/2025 Noca ..... E04B 1/14
2002/0092249 A1 * 7/2002 Yin ..... E04B 5/026 52/263
2006/0075707 A1 * 4/2006 Cretti ..... E04B 5/04 52/414
2006/0168906 A1 * 8/2006 Tonyan ..... B32B 3/06 428/323
2007/0137133 A1 * 6/2007 Bartels ..... E04B 5/43 52/633
2008/0184663 A1 * 8/2008 Martirossyan ..... E04C 2/044 52/745.19
2009/0064617 A1 * 3/2009 Montoya ..... E04B 5/043 52/425
2009/0113820 A1 * 5/2009 Deans ..... E04B 1/14 52/800.1
2010/0024355 A1 * 2/2010 Malapert ..... E04C 2/288 52/794.1
2010/0117249 A1 * 5/2010 Echauri Senosiain ..... B28B 23/028 264/35
2011/0259401 A1 * 10/2011 Bathon ..... B23K 20/122 126/634
2011/0265408 A1 * 11/2011 Jha ..... C08K 7/28 52/656.5
2011/0268912 A1 * 11/2011 Bowman ..... E04C 2/044 428/99
2012/0192516 A1 * 8/2012 Hillers ..... E04B 1/90 52/309.4
2013/0036696 A1 * 2/2013 Moroschan ..... E04B 2/16 52/745.1
2013/0189471 A1 * 7/2013 Ashelin ..... A62C 2/18 428/212
2016/0222651 A1 * 8/2016 MacKinlay ..... E04C 2/288
2020/0123761 A1 * 4/2020 Garcia-Abril Ruiz .. E04B 1/167
2021/0301528 A1 * 9/2021 Dombowsky ..... E04C 2/52
2022/0009196 A1 * 1/2022 Klein ..... B32B 13/06
2022/0049495 A1 * 2/2022 Strong ..... E04B 5/48
2022/0170264 A1 * 6/2022 Badin Cherit ..... E04C 5/065
2023/0373856 A1 * 11/2023 Bradley ..... C04B 32/02
2025/0154761 A1 * 5/2025 Blackburn ..... E04B 1/355

* cited by examiner

WALL PANEL WITH WINDOW APERTURE

FIELD OF THE INVENTION

The present invention relates to the field of construction, specifically and more particularly to constructional building wall panels with a window aperture.

BACKGROUND OF THE INVENTION

As closest technical solution (prototype) should be regarded the wall panel with window aperture (patent RU2670791, published on 25 Oct. 2018). The wall panel consists of a first plate, a first thermal insulation layer, a second thermal insulation layer and a second plate arranged sequentially one by another, wherein horizontal and vertical ribs are set on the first plate's side that faced to the second plate. Before mentioned horizontal and vertical ribs are configured with the first plate. The first thermal insulation layer is set on the first plate between the adjacent vertical ribs closest to one another and the adjacent horizontal ribs closest to one another. The aperture intended for window installation (hereafter referred as window aperture) is cut through the wall panel. The window aperture is partially defined by respective surfaces of adjacent horizontal ribs and vertical ribs closest to the window aperture. Furthermore, fire-fighting elements covering the second thermal insulation layer are built between the horizontal ribs closest to the window aperture and the second plate, as well as between the vertical ribs closest to the window aperture and the second plate, there are disposed fire-fighting elements covering the second thermal insulation layer. Fire-fighting elements are disposed flush with their respective horizontal ribs and vertical ribs, and the second plate protrudes in relation thereto. On the protruding portion of the second plate there oriented towards faced to the window aperture is configured inclined with the narrowing of the reveal at the point of its transition into the second plate. Thus, the distance between above mentioned reveals and surface of horizontal ribs and vertical ribs is inconsiderable; these reveals form so-called thermal bypasses causing significant heat losses during operation. Moreover, manufacturing process of the second plate with mentioned reveals is extremely labour-consuming, as it is difficult to ensure the penetration of the concrete mixture into a narrow gap of casting mold. The prototype is disadvantageous in that it has thermal bridges, the manufacture of structural elements is complicated.

The technical result is to eliminate thermal bridges, simplify manufacture of structural elements.

The technical result at hand is achieved by the fact that in the wall panel with a window aperture comprising a first plate, a second plate, ribs, cross members, two groups of first thermal insulation layers, a second thermal insulation layer, thermal insulation elements and flexible links, the first plate and the second plate are made of concrete-containing material, wherein the first plate is provided with a first surface and a third surface that are located on opposite sides of the first plate, the first surface and the third surface are arranged to have larger areas as compared to the other surfaces of the first plate, each of the ribs and each of the cross members are configured in the form of a bar, the second plate is provided with a second surface and a fourth surface that are located on opposite sides of the second plate, the second surface and the fourth surface are configured to have larger areas compared to the other surfaces of the second plate, the ribs and the cross members are located on the third surface of the first plate, the ribs and the cross members are configured integral with part of the first plate, the ribs are disposed at a distance from one another substantially parallel to one another and perpendicular to the cross members, each first thermal insulation layer of one group is disposed on the third surface between the respective thereto, closest to one another ribs and sections of the cross members located between said ribs, each first thermal insulation layer is disposed flush with the surfaces of the ribs and the cross members that are opposite to the first plate, the second thermal insulation layer is disposed on the first thermal insulation layers and also on the surfaces of the ribs and the cross members that are opposite to the first plate, the fourth surface of the second plate is disposed on the second thermal insulation layer, on two opposite sides of the window aperture that are parallel to the ribs and on one side of the window aperture that is parallel to the cross members, the second plate creates thrust lugs, the second plate and ribs are connected through the second thermal insulation layer by means of the flexible links, characterized in that between each the rib closest to the window aperture and the thrust lug closest to said rib there is disposed respective thereto a first thermal insulation layer of the other group, between the cross member closest to the window aperture and the thrust lug closest thereto there is disposed respective thereto a first thermal insulation layer of the other group, each thermal insulation element is disposed between the first plate and the second plate and covers the first thermal insulation layer and the second thermal insulation layer from the side of the window aperture, wherein the thrust lugs protrude on the side of the window aperture with respect to the thermal insulation element.

In another embodiment of the invention said ribs made of fibroconcrete with a compressive strength of more than 25 MPa, inside they are reinforced with rod fittings with a diameter of at least 10 mm.

In another embodiment of the invention said ribs combined by a stiffness disk, they work together, perceiving the main loads from the overlying elements.

In another embodiment of the invention said flexible links are made of fiberglass, have two varieties in length, they are installed at an angle of 900, others at an angle of 450.

In another embodiment of the invention said first thermal insulation layer of the other group are made of fire-fighting type of insulation and are a fire cut-off.

BRIEF DESCRIPTION OF DRAWINGS

The technical solution is explained by the drawings (FIG. 1-2), where.

DETAILED DESCRIPTION OF THE INVENTION

Figure 1:
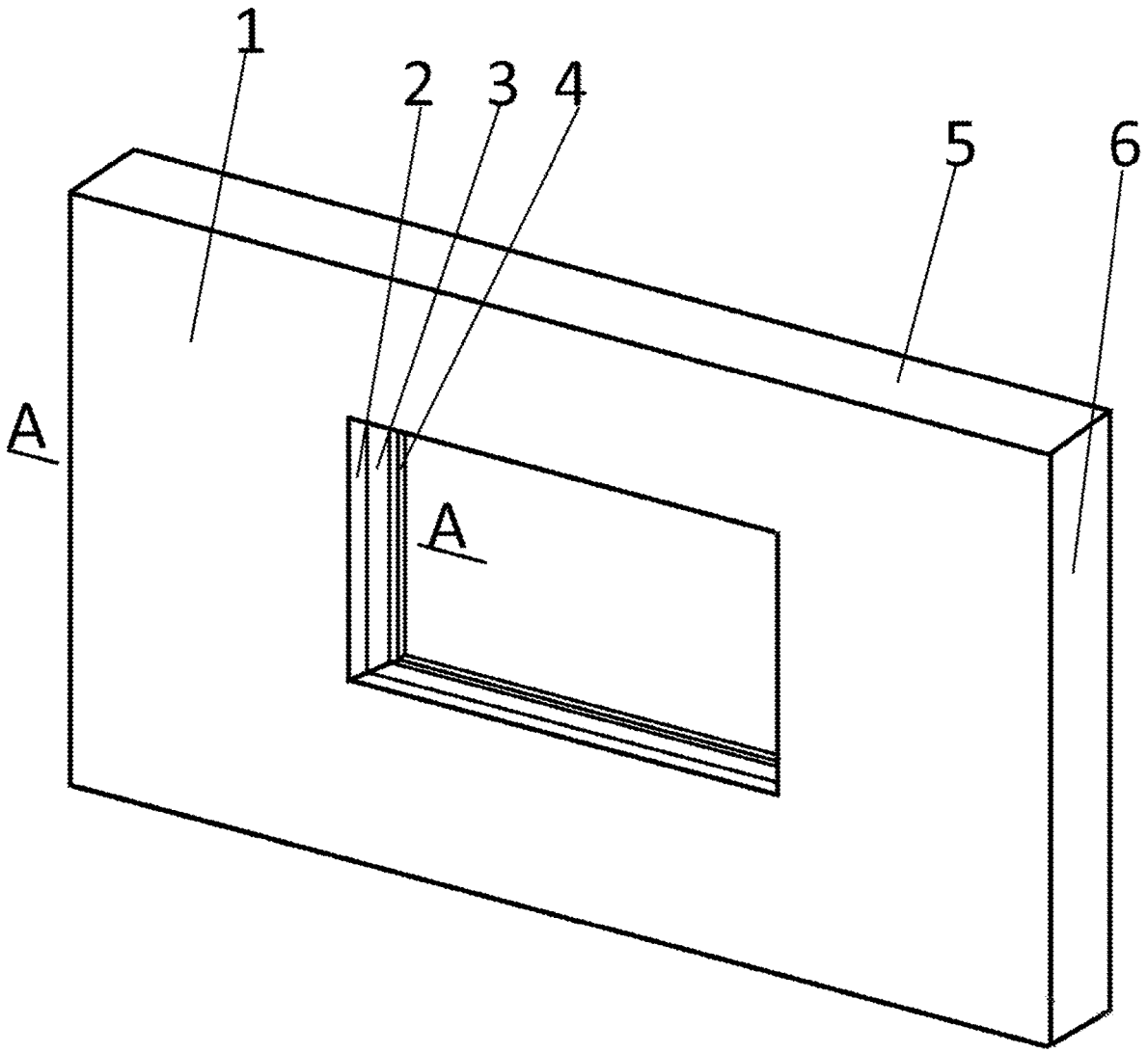
FIG. 1 shows a general view of the wall panel with a window aperture.
Figure 2:
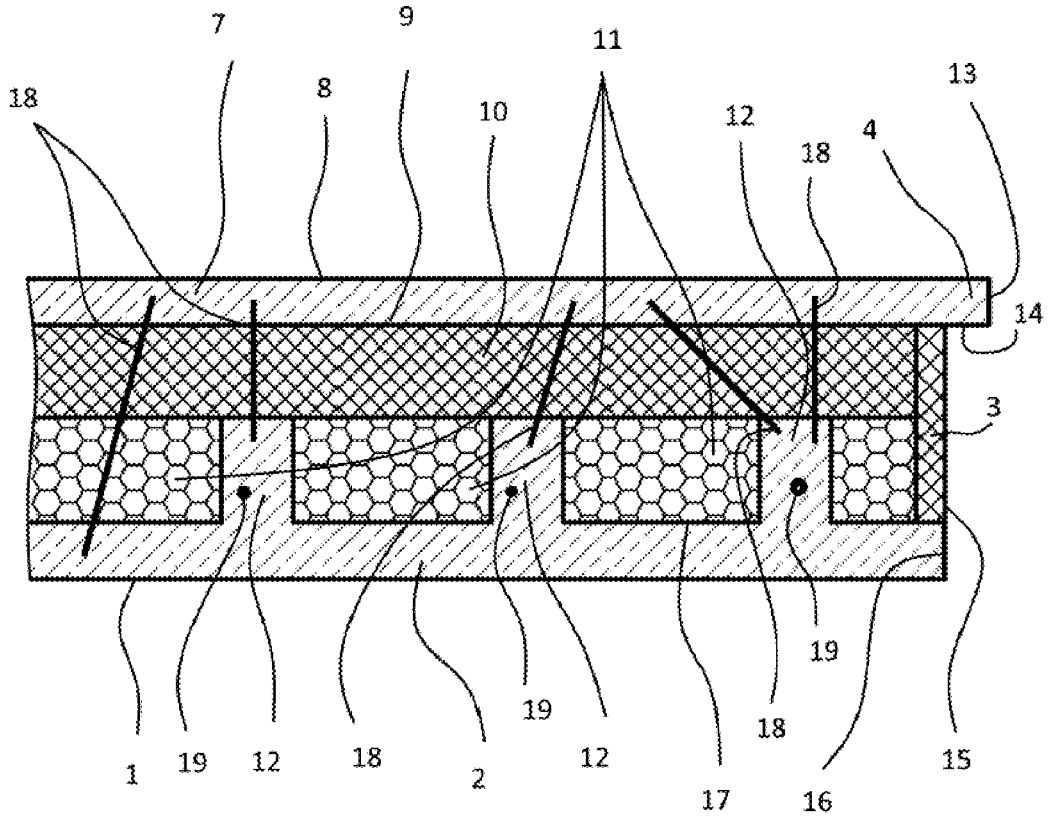
FIG. 2 shows a sectional view of the wall panel from the window aperture.

Symbols designates: first surface 1, first plate 2, thermal insulation element 3, thrust lug 4, upper surface 5, lateral surface 6, second plate 7, second surface 8, fourth surface 9, second thermal insulation layer 10, first thermal insulation layer 11, rib 12, second extreme surface 13, stop surface 14, third extreme surface 15, first extreme surface 16, third surface 17, flexible link 18, rod fitting 19.

Hereinafter, the references to upper and lower correspond to the direction of the gravity vector while a given arrangement is in typical operational disposition. The terms horizontal and vertical and their derivatives are understood to refer to disposition perpendicular to or parallel to the gravity vector, respectively.

The main elements of the arrangement are a first plate 2 with ribs 12, first thermal insulation layers 11, a second thermal insulation layer 10, a second plate 7 and thermal insulation elements 3.

The wall panel is restricted by the first surface 1 (being part of the first plate 2), a second surface 8 (being part of the second plate 7), an upper surface 5, a lower surface and two lateral surfaces 6. The first surface 1 and the second surface 8 of the wall panel are of largest areas as compared to the other surfaces of the wall panel. The first surface 1 and the second surface 8 are set on opposite sides of the wall panel, substantially parallel to one another. The upper surface 5 and the lower surface are set on opposite sides of the wall panel substantially parallel to one another. The lateral surfaces 6 are arranged on opposite sides of the wall panel substantially parallel to one another. During common operation, the first surface 1 is oriented towards the interior of the building and the second surface 8 is oriented outwards the building. Furthermore, the first surface 1, the second surface 8 and the lateral surfaces 6 are vertical oriented. The other two surfaces, the upper surface 5 and the lower surface, are horizontal oriented.

The wall panel has a window aperture. A window aperture is an aperture for mounting one or more window units. An aperture is an opening in a wall, for example, a window aperture. The window aperture is made in form of through hole from the first surface 1 to the second surface 8 of the wall panel. The shape of the window aperture is configured substantially rectangular, wherein in a particular embodiment two edges of the window aperture are substantially parallel to the lateral surfaces 6 and the ribs 12, and the other two edges are substantially parallel to the upper surface 5, the lower surface and the cross members.

The first plate 2 represents itself a parallelepiped whose two linear dimensions are significantly larger than the third linear dimension. Two larger surfaces of the first plate 2 are hereinafter referred as the first surface 1 and the second surface 8. The first surface 1 is oriented towards building's interior, and the third surface is oriented towards the interior of the wall panel to the first thermal insulation layer 11 and the second plate 7. From the side of the window aperture, the first plate 2 is restricted by the first margin surfaces 16. On the third surface there are ribs 12.

The rib 12 is configured in the form of a beam. The rib 12 is configured integral with the first plate 2. On the first plate 2 there are disposed multiple ribs 12. The Ribs 12 are disposed substantially parallel to one another and to the lateral surfaces 6 of the wall panel. The Ribs 12, arranged in the closest proximity to the first margin surfaces 16 of the first plate 2, are spaced from the first extreme surfaces 16 to enable placement between the first extreme surface 16 and the closest thereto rib 12 the portion of the first thermal insulation layer 11 and the thermal insulation element 3.

Also, it's possible to set cross members on the third surface of the first plate 2. Each cross member is configured in the form of a bar of a rectangular or trapezoidal cross section. The Cross members are set substantially perpendicular to the ribs 12. The wall panel is equipped with at least two cross members, one disposed in the proximity to the upper surface of the wall panel, the other one disposed in the proximity to the lower surface of the wall panel. In a particular embodiment, the wall panel may be equipped with cross members proximal to the window aperture.

The second plate 7 is configured in the form of a flat parallelepiped. The second surface 8 and the fourth surface of the second plate 7 are disposed on the opposite sides thereof and have the largest areas as compared to the other surfaces of the second plate 7. In working condition, the second surface 8 is oriented to the outside of the building. The fourth surface is disposed on the second thermal insulation layer 10. Furthermore, the fourth surface is oriented interiorly to the wall panel towards the first plate 2 and contacts with the second thermal insulation layer 10, ribs 12 and cross members. From the window aperture side the second plate 7 is restricted by the second margin surfaces 13.

The first plate 2 with ribs 12 and cross members, and the second plate 7 are made of a material with a predominant content of concrete, various types of concrete are known from background, for example, concrete or reinforced concrete. Said elements are typically reinforced by placing metal rods in the ribs 12 and cross members, and metal mesh in the first plate 2 and second plate 7. Said reinforcing elements may be connected to one another or disposed separately from one another.

The first thermal insulation layers 11 are disposed on the third surface of the first plate 2. Further, the first thermal insulation layers 11 are disposed substantially flush with the surfaces of the ribs 12 and those of the cross members, farthest from the third surface. The first thermal insulation layers 11 are made of a material with maximum thermal insulation capacity, for example, polystyrene foam. The first thermal insulation layers 11 used in the arrangement may be tentatively divided into two groups differing from one another in terms of disposition, not properties. Each first thermal insulation layer 11 of the first group is disposed in a niche formed by the third surface and the respective to said first thermal insulation layer, closest to one another two ribs 12 and sections of cross members disposed between said ribs 12. The respective to said element (the first thermal insulation layer 11) objects (ribs 12 or cross members) refer to objects (ribs 12 and cross members) that are disposed in close proximity thereto and/or are in contact therewith. Each first thermal insulation layer 11 of the other group is disposed on the third surface on the side of the window aperture up to the ribs 12 and cross members closest to the window aperture.

The second thermal insulation layer 10 is disposed on the first thermal insulation layer 11 and on the ribs 12 and cross members. The second thermal insulation layer 10 may be manufactured of any thermal insulation material, for example, mineral wool or foam glass. The shape of the second thermal insulation layer 10 is like a parallelepiped whose two linear dimensions are larger than the third linear dimension. Furthermore, structure of secondary thermal insulation layer 10 may be either monolithic or composite. On the opposite side of the first thermal insulation layer 11, the second thermal insulation layer 10 contacts the fourth surface of the second plate 7.

The thermal insulation element 3 is configured in the form of a flat parallelepiped whose two opposite surfaces have larger areas than the other surfaces thereof. The thermal insulation element 3 is made of a fireproof thermal insulation material with fireproof properties, for example, of mineral wool. Each thermal insulation element 3 is disposed on the side of the window aperture between the first plate 2 and the second plate 7. The third extreme surface 15 of each thermal insulation element 3 is oriented towards the window aperture. Furthermore, the third extreme surface 15 is arranged substantially within the same plane with the first extreme surface 16 of the first plate 2.

The thrust lugs 4 are formed by the second plate 7 on two opposite sides of the window aperture parallel to the ribs 12, as well as one side of the window aperture parallel to the cross members. Furthermore, the second extreme surface 13 of the second plate 7 protrudes in relation to the third extreme surface 15 and the second extreme surface 13. The portion of the fourth surface protruding over the thermal insulation element 3 is referred to as a stop surface 14 for the convenience of further description.

The connection of the first plate 2 and the second plate 7 with one another, in a particular embodiment, is provided by means of flexible links. A flexible link is a link (rod element) made of corrosion-resistant steel or other corrosion-resistant material, such as glass fiber-reinforced polymer or basalt fiber reinforced polymer. Each flexible link is attached with one end thereof in the material of the first plate 2 and/or in that of any rib 12 or cross member, and with the other end in the material of the second plate 7. Further, the axis of each flexible link may be either perpendicular to or at an angle to the second plate 7. Further, between two flexible links disposed in the proximity of one another with axes perpendicular to the second plate 7, there is typically placed a flexible link with the axis being at an angle to the second plate 7. Further, flexible links extend through the second thermal insulation layer 10 and may extend through the first thermal insulation layer 11.

Description the Preferred Embodiment

When the above elements and means are employed, the technical solution is implemented as follows (while the provided description of the object illustrates a particular embodiment thereof, other embodiments are also possible with using the features of the present technical solution).

A removable formwork is installed on a vibrating table to form the upper surface 5, the lower surface and two lateral surfaces 6 of the wall panel. Also, a formwork is installed to form a window opening. Further, on the side of the future window aperture, the formwork is configured with a protruding portion of the mold to form the thrust lugs 4 of the second plate 7. If necessary, reinforcing elements are installed. Concrete mortar is poured to form the second plate 7. Flexible links are installed into the uncured concrete mortar. A vibrating table is turned on to ensure a denser material structure during setting. After setting of the concrete mortar and primary hardening, thermal insulation is installed. The vibrating table is turned off. On the side of the formwork, the thermal insulation elements 3 are installed to form a window aperture. Next, thermal insulation plates are laid on the fourth surface of the second plate 7 to form the second thermal insulation layer 10. Thermal insulation plates are laid on the second thermal insulation layer 10 to form the first thermal insulation layer 11. The thermal insulation plates are laid at a distance to one another, allowing for cross members and the ribs 12 to be formed further. Further, said thermal insulation plates are fitted onto flexible links. Further, the first thermal insulation layer 11, the thermal insulation elements 3 and the second thermal insulation layer 10 act as a non-removable formwork to form the first plate 2 with the ribs 12 and cross members.

If it is necessary to form communication holes and connecting holes, holes are provided in the first thermal insulation layer 11 and the second thermal insulation layer 10. Concrete hole formers are installed into said holes. The hole formers may be cylindrical elements, such as pipes or cylinders made of easily removable materials, such as expanded polystyrene, foam, and the like.

Elements of the reinforcing frame, including reinforcing rods connected to one another, are installed into the resulting configuration of formworks prior to pouring concrete mortar (the second plate 7 and the first plate 2 with the ribs 12 and cross members). A reinforcing mesh is applied on top. If necessary, the elements of the reinforcing frame are connected to one another. Embedded parts are installed.

Next, a mortar made of concrete-containing material of the appropriate grade, if necessary supplemented with components adjusting its hardening speed, plasticity, strength, and the like, is poured into the prepared configuration of formworks. The resulting object is left until the mortar hardens. Further, for consolidation of the mortar, the vibrating table is turned on, promoting, by means of vibration, the release of gas bubbles therefrom to the surface of the mortar and the formation of a more durable internal structure. Further, the mortar penetrates into the voids of the first thermal insulation layer 11, the second thermal insulation layer 10, providing a reliable connection of the structural elements of the wall panel to one another. After setting of the mortar, the removable formwork is removed. By means of lifting equipment, the finished wall panel is removed from the vibrating table. Further, flexible links are reliably secured in the concrete body and fix the mutual position of the structural elements relative to the wall panel as a whole.

The wall panel is used in panel housing construction as walls (typically exterior walls) of a building to speed up the construction process. Further, the wall panel is turned to a vertical position and oriented so that the first plate 2 is disposed inside the building, the second plate 7 is disposed outside, the lower surface is disposed at the bottom, and the upper surface 5 is disposed at the top. The wall panels are connected to one another and to slabs, for example, by way of welding pre-installed contact pads (metal embedded parts).

The window unit is installed in the window aperture. The window unit is installed on the side of the first plate 2 to rest against the stop surface 14 of the thrust lug 4. Next, the window unit is secured, and the reveals are decoratively finished. During operation, the prototype design has a problem of thermal bridges. In the prototype, the concrete protrusion of the external plate towards the inner plate, as well as the ribs disposed close thereto, contribute to thermal losses from the room. The invention eliminates this problem due to the fact that there are no protrusions on the second plate 7 towards the first plate 2. Thermal losses are also reduced due to the ribs 12 and cross members displaced away from the window aperture. Further, thermal efficiency is also increased due to the placement of the first thermal insulation layer 11 of the second group on the third surface with adjacency to closest to the window aperture the ribs 12 and the cross members on the side of the window aperture. Furthermore, on the side of the window aperture, the first thermal insulation layer 11 and the second thermal insulation layer 10 are covered with a thermal insulation element 3, which also ensures fire safety of the wall panel. The elements in the window aperture are configured so as to simplify manufacture thereof due to eliminated narrow and winding passages for the concrete mixture during the manufacturing process.

Thus, the implementation of the arrangement with a set of essential features described in the claim provides for the elimination of thermal bridges, simplified manufacture of structural elements as a result of altering the design of the article of manufacture according to the present technical solution.

The invention claimed is:

1. A wall panel with a window aperture, comprising: a first plate, a second plate, ribs and cross members, two groups of a first thermal insulation layer, a second thermal insulation layer, thermal insulation elements and flexible links, the first plate and the second plate are made of concrete-containing material, wherein the first plate is provided with a first surface and a third surface, which surfaces are located on opposite sides of the first plate, the first surface and the third surface are arranged to have larger areas as compared to other surfaces of the first plate, each of the ribs and each of the cross members are configured as a bar, the second plate is provided with a second surface and a fourth surface, which surfaces are located on opposite sides of the second plate, the second surface and the fourth surface are configured to have larger areas compared to other surfaces of the second plate, the ribs and the cross members are located on the third surface of the first plate, the ribs and the cross members are configured to be integral with a part of the first plate, the ribs are disposed at a distance from one another substantially parallel to one another and perpendicular to the cross members, each first thermal insulation layer of one group is disposed on the third surface between the ribs and cross members, each first thermal insulation layer of the one group (11-1) of the two groups is closest to said ribs and sections of the cross members are located between said ribs, each of the groups of the first thermal insulation layer is disposed flush with the surfaces of the ribs and the cross members which are opposite to the first plate, the second thermal insulation layer is disposed on the first thermal insulation layer and also on the surfaces of the ribs and the cross members which are opposite to the first plate, the fourth surface of the second plate is disposed on the second thermal insulation layer, on two opposite sides of the window aperture which are parallel to the ribs and on one side of the window aperture which is parallel to the cross members, the second plate creates thrust lugs, the second plate and ribs are connected through the second thermal insulation layer by the flexible links, wherein between each rib closest to the window aperture and a thrust lug closest to said rib, there is disposed a first thermal insulation layer of the other group, between the cross member closest to the window aperture and the thrust lug closest thereto, there is disposed first thermal insulation layers of the other group, each thermal insulation element is disposed between the first plate and the second plate and covers the first thermal insulation layer and the second thermal insulation layer from the side of the window aperture, and wherein at least one thrust lug protrudes on each side of the window aperture with respect to the thermal insulation elements.

2. The wall panel with the window aperture of claim 1, wherein said ribs are made of fibroconcrete with a compressive strength of greater than 25 MPa, and inside they are reinforced with rod fittings with a diameter of at least 10 mm.

3. The wall panel with the window aperture of claim 1, wherein said flexible links are made of fiberglass, have two varieties in length, and they are installed at an angle of 90° and 45°.

4. The wall panel with the window aperture of claim 1, wherein said first thermal insulation layer of the other group is made of fire-fighting type of insulation and is a fire cut-off.

* * * * *